US008042346B2

(12) United States Patent
Oh et al.

(10) Patent No.: US 8,042,346 B2
(45) Date of Patent: Oct. 25, 2011

(54) REFRIGERATOR

(75) Inventors: Seung Jin Oh, Daegu (KR); Sung Ae Lee, Busan (KR); Ji Won Jeon, Seoul (KR); Hee Soo Son, Busan (KR); Ik Kyu Lee, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 664 days.

(21) Appl. No.: 11/993,824

(22) PCT Filed: Jun. 22, 2006

(86) PCT No.: PCT/KR2006/002418

§ 371 (c)(1),
(2), (4) Date: Oct. 30, 2008

(87) PCT Pub. No.: WO2006/137707

PCT Pub. Date: Dec. 28, 2006

(65) Prior Publication Data

US 2010/0043466 A1 Feb. 25, 2010

(30) Foreign Application Priority Data

| | | |
|---|---|---|
| Jun. 23, 2005 | (KR) | 10-2005-0054268 |
| Jul. 30, 2005 | (KR) | 10-2005-0070060 |
| Sep. 23, 2005 | (KR) | 10-2005-0088855 |
| Sep. 23, 2005 | (KR) | 10-2005-0088857 |
| Sep. 29, 2005 | (KR) | 10-2005-0091247 |
| Oct. 5, 2005 | (KR) | 10-2005-0093522 |

(51) Int. Cl.
*F25B 49/00* (2006.01)

(52) U.S. Cl. ..... 62/125; 236/51; 236/94

(58) Field of Classification Search ..... 62/125, 62/126, 127, 129; 236/51, 94
See application file for complete search history.

(56) References Cited

U.S. PATENT DOCUMENTS

| | | | | |
|---|---|---|---|---|
| 6,393,848 | B2 | 5/2002 | Roh et al. | |
| 6,714,222 | B1 * | 3/2004 | Bjorn et al. | 715/839 |
| 2001/0010516 | A1 | 8/2001 | Roh et al. | |

FOREIGN PATENT DOCUMENTS

| | | | | |
|---|---|---|---|---|
| CN | 101231085 | A | * | 7/2008 |
| EP | 1 237 103 | A1 | | 9/2002 |
| GB | 2 394 032 | A | | 4/2004 |
| JP | 3036554 | U | | 2/1997 |
| JP | 2001-195419 | A | | 7/2001 |
| JP | 2002-63095 | A | | 2/2002 |
| JP | 2002-279288 | A | | 9/2002 |
| KR | 10-2001-0016945 | A | | 3/2001 |
| KR | 10-2002-0005855 | A | | 1/2002 |
| KR | 10-2002-0074096 | A | | 9/2002 |
| KR | 10-2004-0044666 | A | | 5/2004 |
| KR | 10-2005-0083259 | A | | 8/2005 |
| SU | 960502 | A1 | | 9/1982 |

* cited by examiner

*Primary Examiner* — Marc Norman
(74) *Attorney, Agent, or Firm* — Birch, Stewart, Kolasch & Birch, LLP

(57) ABSTRACT

The present invention relates to a refrigerator. The refrigerator includes a receiver unit for receiving information required for every day life, a control unit for determining information a user is in need from the information required for every day life, and a display unit for displaying the information the user is in need to an outside of the refrigerator.

18 Claims, 7 Drawing Sheets

[Fig. 1]
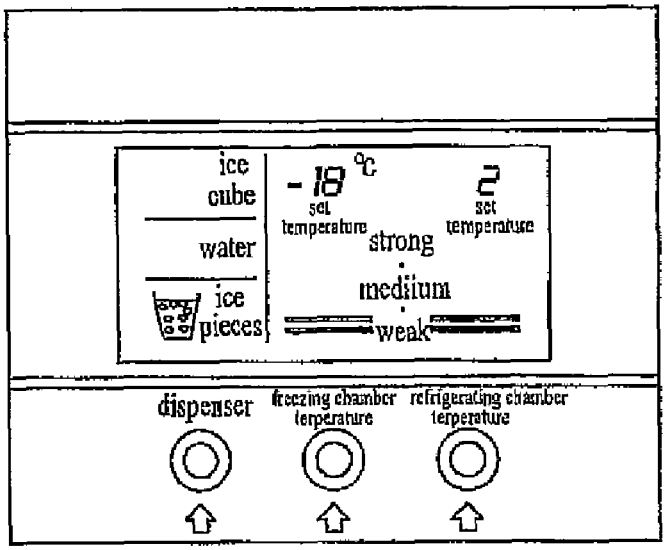
[Fig. 2]
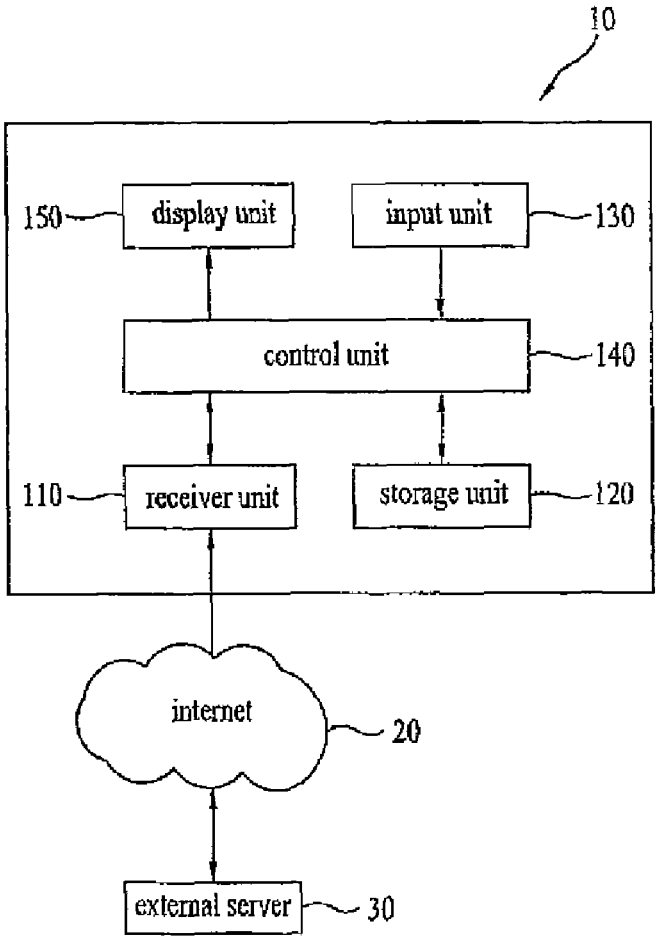

[Fig. 3]
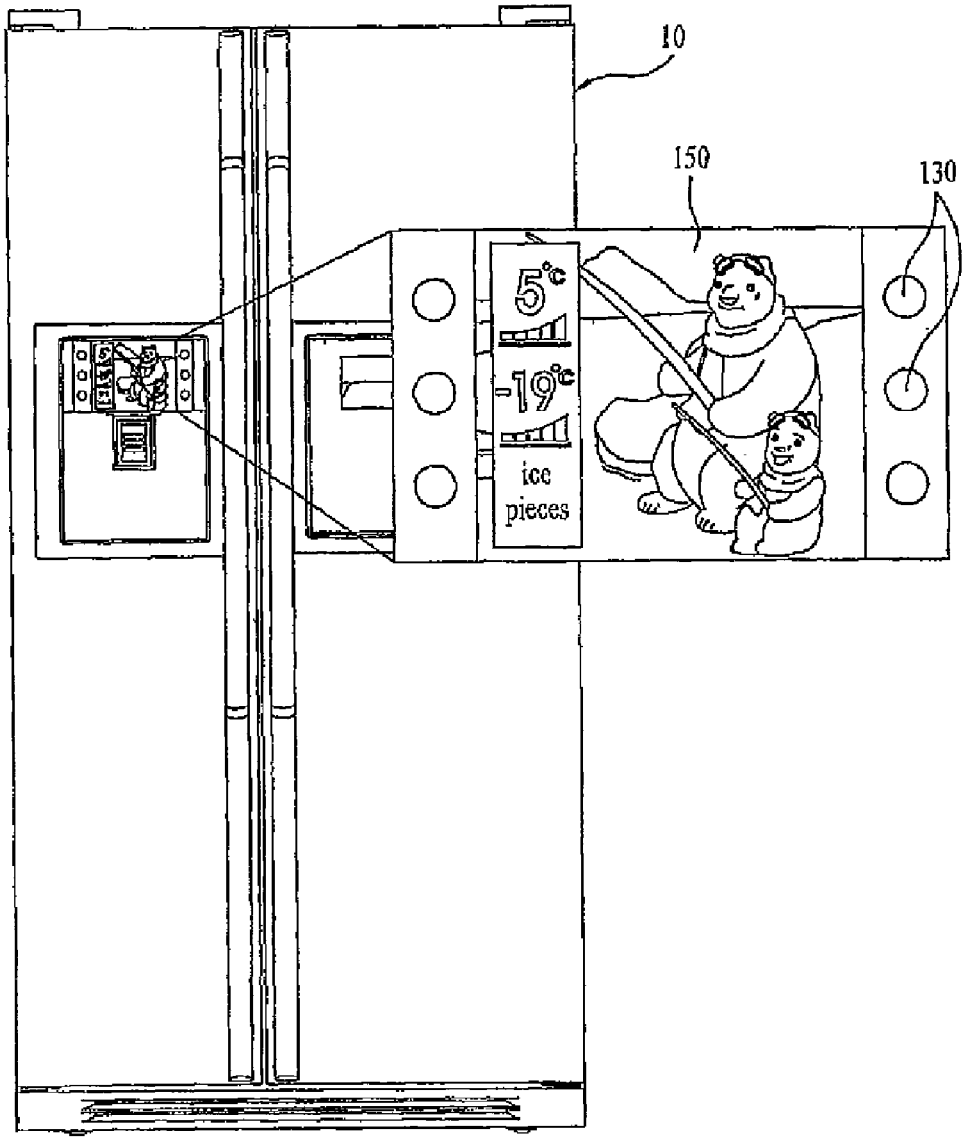
[Fig. 4]
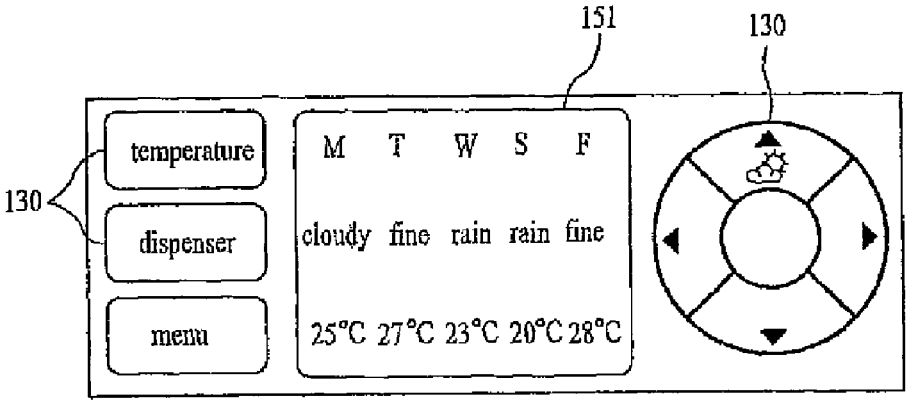

[Fig. 5]
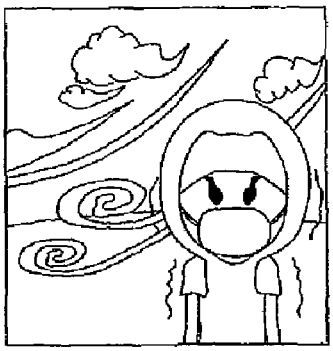
[Fig. 6]
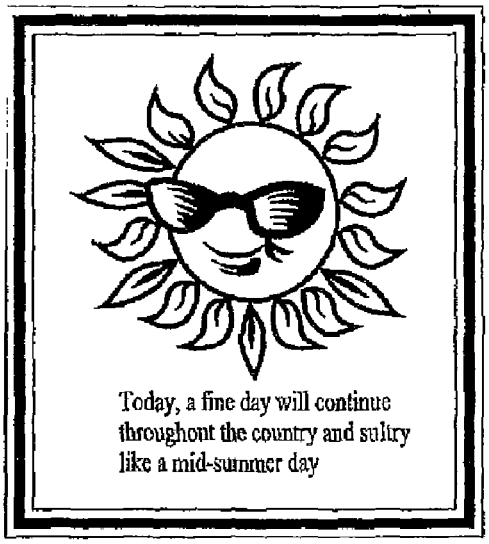
[Fig. 7]
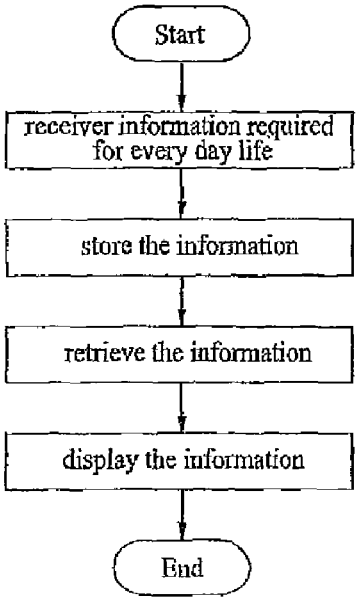

[Fig. 8]
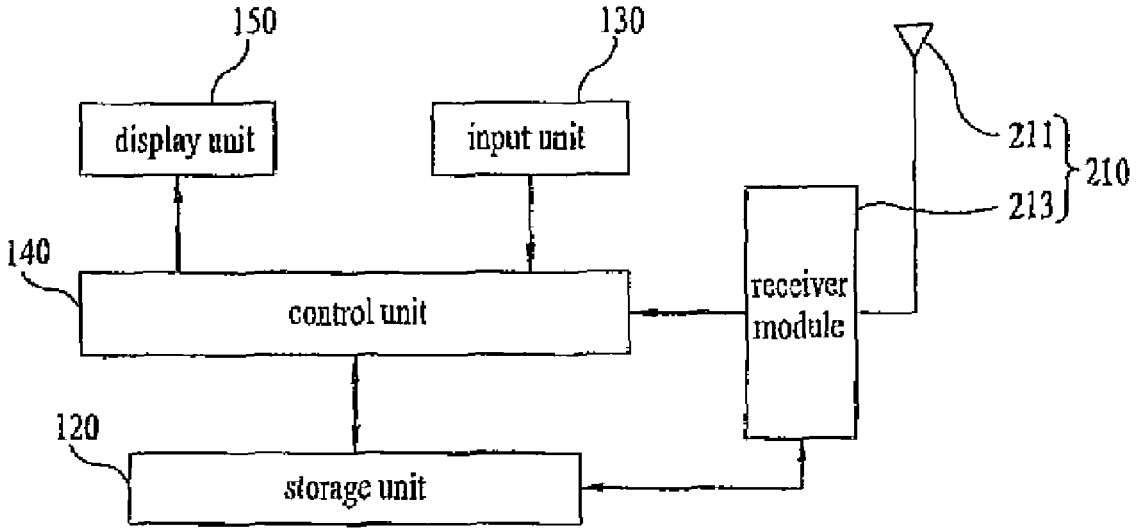

[Fig. 9]
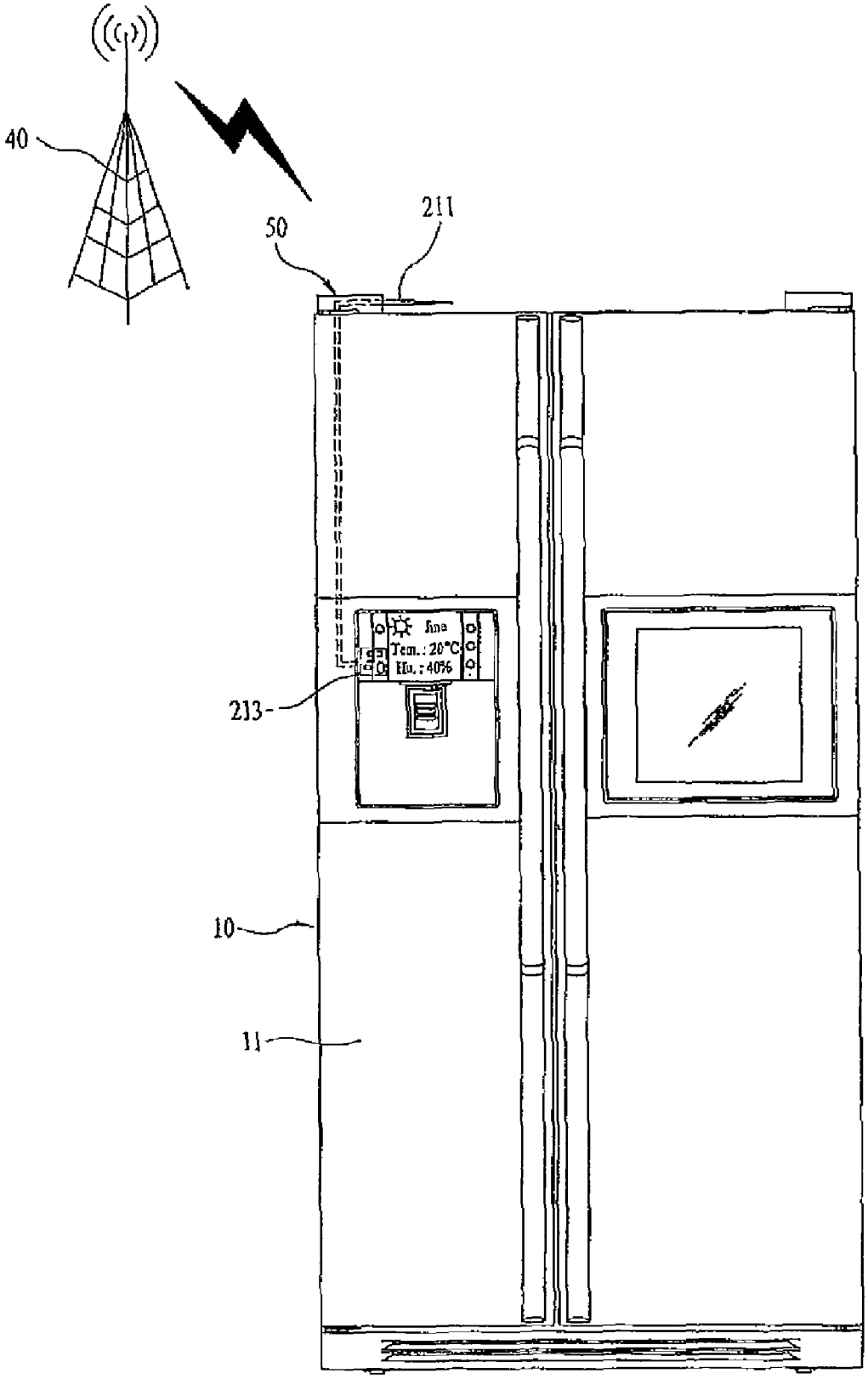

[Fig. 10]
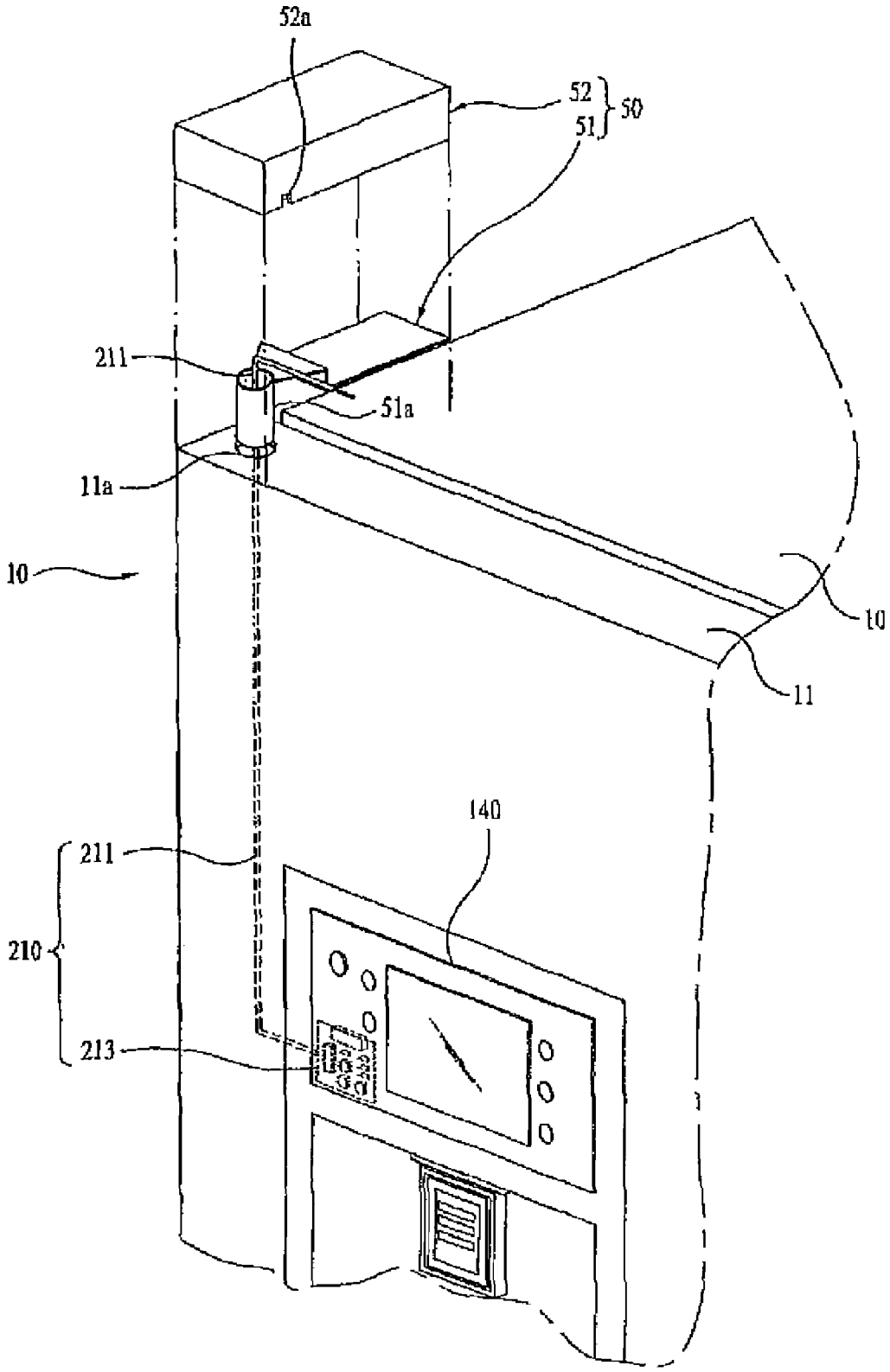

[Fig. 11]
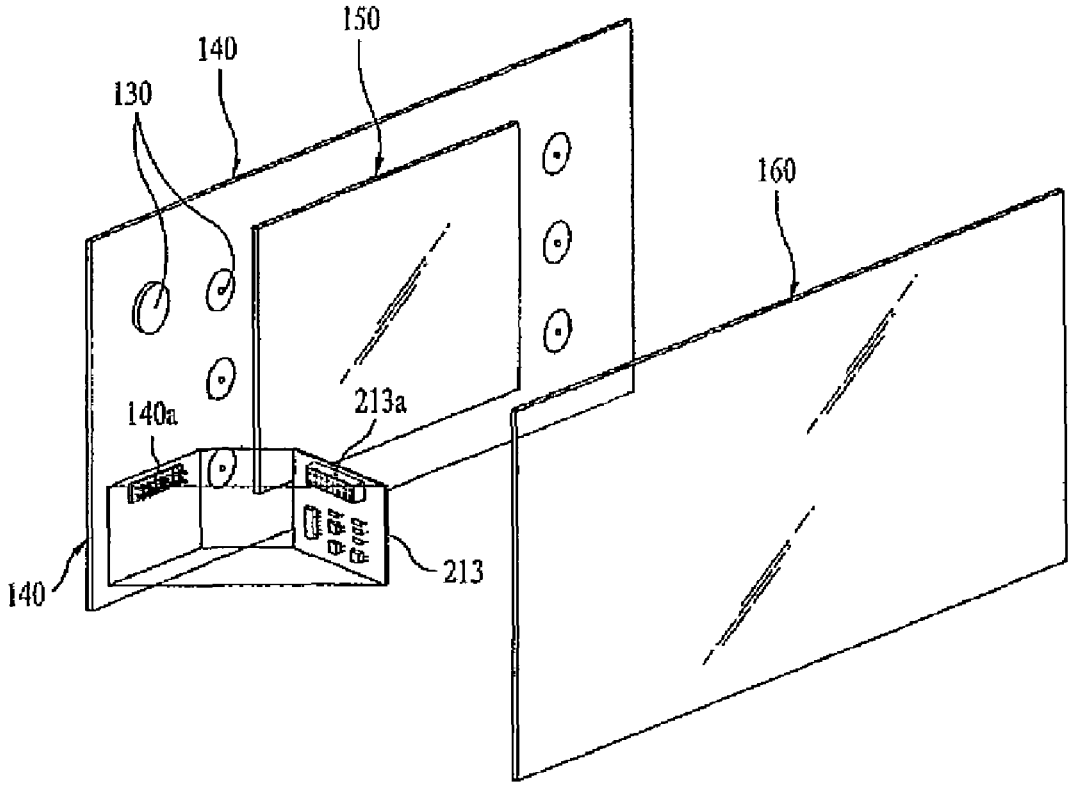

REFRIGERATOR

TECHNICAL FIELD

The present invention relates to refrigerators, and more particularly, to a refrigerator which can provide information required for every day life, inclusive of information on weather, for improving functions, and convenience and efficiency of the refrigerator.

BACKGROUND ART

In order to provide information on a present state, or control operation of a refrigerator, a related art refrigerator is provided with a control panel on an outside surface of a door, having a display unit, such as an LCD window, and an input unit, such as various buttons.

The display unit displays the present state of the refrigerator, such as a freezing chamber temperature, a refrigerating chamber temperature, a service state of a dispenser (for an example, whether the dispenser dispenses water, or ice), and so on.

According to this, the user can know a state of the refrigerator from the display unit.

The input unit is provided for the user to set the freezing chamber temperature, the refrigerating chamber temperature, and the service state of the dispenser, to enable the user to make operation of the refrigerator to a state the user desires.

Therefore, the user can set or change the freezing chamber temperature, the refrigerating chamber temperature, and the service state of the dispenser by using the input unit.

FIG. 1 illustrates a control panel of a related art refrigerator, schematically.

A display unit on the control panel is an LCD window, for displaying a service mode of the dispenser (ice cubes, water, or ice pieces), the freezing chamber temperature, the refrigerating chamber temperature, and so on.

The input unit on the control panel is provided with various kinds of buttons, such as dispenser buttons, a freezing chamber button, a refrigerating chamber button, for setting or changing the service mode of the dispenser, the freezing chamber temperature, and the refrigerating chamber temperature.

However, the related art refrigerator can only provide inside information, such as the present stale of the refrigerator, but can not provide various outside information other than the inside information.

For an example, in a case the user needs information on weather while the user is in a kitchen wherein the refrigerator is installed, since the user is required to obtain the information from media, such as a TV, or radio, mostly provided in a space other than the kitchen, the process is cumbersome and ineffective.

DISCLOSURE OF INVENTION

Technical Problem

An object of the present invention is to provide a refrigerator which can improve functions of the refrigerator, convenience of use, enhance information utilization, and a life quality of the user.

Technical Solution

The object of the present invention can be achieved by providing a refrigerator including a receiver unit for receiving information required for every day life, a control unit for determining information a user is in need from the information required for every day life, and a display unit for displaying the information the user is in need to an outside of the refrigerator.

The information required for every day life may include information on weather, and the information on weather includes information on weather in the future.

The information required for every day life may include information on a particular day in the future, or information on a particular period in the future which can be selected by the user.

The information required for every day life may include information on weather, and information on food relevant to the information on weather.

Preferably, the information required for every day life includes the information on food includes information on price of the food.

The receiver unit receives the information required for every day life from an external network through wire or radio, includes an antenna, and a receiver module for receiving the information required for every day life from a radio wave through the antenna, and can be detachably mounted on one side of a body of the refrigerator.

Preferably, the antenna has one side connected to the receiver module, and the other side projected outward from a top side of a refrigerator door.

The antenna may be projected outward through a door hinge on the top of the refrigerator, and the hinge may have a hole formed therein through which the antenna passes.

The receiver module may be coupled with the control unit of the refrigerator by terminal coupling.

The refrigerator may further include a storage unit for storing the information required for every day life, and the information relevant to the information required for every day life.

The information relevant to the information required for every day life may be avatar information, or regional information.

The refrigerator may further include an input unit for inputting the information relevant to the information required for every day life.

The display unit displays the information the user is in need with characters, or with an avatar, and the display unit preferably displays the information the user selects.

Advantageous Effects

The refrigerator of the present invention has the following advantages.

First, the refrigerator of the present invention can improve functions of the refrigeration.

Second, the refrigerator of the present invention can improve user's convenience and efficiency by providing various kinds of information required for every day life to the user.

Third, the refrigerator of the present invention can improve efficiency of information.

Fourth, the refrigerator of the present invention can improve user's economy and quality of life.

BRIEF DESCRIPTION OF THE DRAWINGS

The accompanying drawings, which are included to provide a further understanding of the invention, illustrate embodiment(s) of the invention and together with the description serve to explain the principle of the invention. In the drawings;

FIG. 1 illustrates a control panel of a related art refrigerator, schematically;

FIG. 2 illustrates a block diagram of a refrigerator in accordance with a first preferred embodiment of the present invention, schematically;

FIG. 3 illustrates a front view of a refrigerator in accordance with a first preferred embodiment of the present invention, schematically;

FIG. 4 illustrates a front view of a display unit and an input unit of the refrigerator in FIG. 3, schematically;

FIG. 5 illustrates a front view of an embodiment of an avatar displayed on the display unit in FIG. 3, schematically;

FIG. 6 illustrates a front view of another embodiment of the avatar in FIG. 5, schematically;

FIG. 7 illustrates a flow chart of a process for displaying information required or every day life on the refrigerator in FIG. 3;

FIG. 8 illustrates a block diagram of a refrigerator in accordance with a second preferred embodiment of the present invention, schematically;

FIG. 9 illustrates a front view of a refrigerator in accordance with a second preferred embodiment of the present invention, schematically;

FIG. 10 illustrates a perspective view of major units of the refrigerator in FIG. 9, schematically; and FIG. 11 illustrates a perspective view a receiver unit of the refrigerator in FIG. 9, showing a method for mounting a receiving module therein on a control unit, schematically.

BEST MODE FOR CARRYING OUT THE INVENTION

Reference will now be made in detail to the preferred embodiments of the present invention, examples of which are illustrated in the accompanying drawings. In describing the embodiments of the present invention, a refrigerator 10 set forth in the present invention is two door refrigerator 10 having a dispenser provided thereto. Of course, the refrigerator 10 set forth in the present invention includes a general refrigerator having no dispenser provided thereto.

A refrigerator 10 in accordance with a first preferred embodiment of the present invention will described with reference to FIGS. 2 to 7.

Referring to FIGS. 2 and 3, the refrigerator 10 in accordance with a first preferred embodiment of the present invention includes a receiver unit 110 for receiving information required for every day life, a storage unit 120 for storing the information required for every day life received from the receiving unit 110, and information relevant to the information required for every day life, an input unit for inputting information relevant to the information required for every day lie to the storage unit 120, a control unit 140 for determining information the user desires from the information required for every day life, and a display unit 150 for displaying the information the user desires to an outside of the refrigerator.

The receiver unit 110 is designed to receive information required for every day life from an external network through a wired communication system. That is, the receiver unit 110 of the refrigerator 10 is connected to an external server 30 with the wired communication system, which provides the information required for every day life through a network 20, such as the Internet, to make data communication therewith. The Internet 20 is general communication means including all, such as an internet service provider (ISP), physical cables, and so on. In detail, the receiver unit 110 is a kind of communication port connected to the network 20 such as Internet, for an example, a device like a modem, and the external server 30 is a device for providing information required for every day life, such as a weather forecasting server for providing information on weather, a food information server for providing information on food, or the like.

In the meantime, of embodiments of the external server 30, the information required for every day life the weather forecasting server provides is information on weather mostly, including information on weather in the future, information on weather on a particular day or particular period in the future. That is, the weather forecasting server generates weather forecasting information by using weather satellites, and radars, automatic weather observation data, numerical forecasting model data, and so on, and provides the weather forecasting information generated thus to the receiver unit 110 accessed through the Internet 20. The weather forecasting information may be a short term weather forecast, such as after a few days or after a few hours in the future, or a long term weather forecast, such as after a few weeks, or after a few months in the future. Moreover, the weather forecast information may be a weather forecast for each of regions, or countries. Or, the weather forecast information may be a weather forecast on a designated day, or period.

Of the embodiments of the external server 30, the information required for every day life the food information server provides is information on food relevant to the information on weather the weather forecasting server provides, preferably including information on price of the food. For an example, the food information server generates food (particularly, fruits) human being is required to take according to a predetermined weather or season, and provides the generated information to the receiver unit 110 having accessed thereto through the Internet 20. In this instance, the information on food includes at least a name of the food, and may include price, a cooking method, a storage method, and so on of the food. It is preferable that the information on price of the food includes information on a range of price of the food sold at certain weather and season, a present approx. price, and so on. Though the information on food may be received from the food information server, the information on food may be received from a manufacturer at the time of manufacturing the refrigerator 10. At the end, the receiver unit 110 accesses to the external server 30 through the Internet 20, for receiving various kinds of information required for every day life from the external server 30 and storing the information in the storage unit 120.

In the meantime, the storage unit 120 can store the information required for every day life received through the receiver unit 110 and information relevant to the information required for every day life. The information relevant to the information required for every day life includes information on a particular day or period in the future the user can select. For an example, in order to control operation of the refrigerator 10, or select a kind of information to be received, the user may store information inputted through the input unit 130. The information relevant to the information required for every day life may also be avatar information or region information the user can select. For an example, in order to select a kind of avatar the user desires, or in order to select a region the user requires, the user may store information inputted through the input unit 130.

The input unit 130 is provided for the user to input the information relevant to the information required for every day life, i.e., information the user requires. That is, as shown in FIG. 4, the input unit 130 may be various types of buttons. Accordingly, by selecting a button relevant to the information the user intends to obtain, the user can obtain only information required for every day life the user desires from information required for every day life received from the receiver unit 110. Of course, the input unit 130 may be of a variety of types, such as touch pad type, different from the button type.

The control unit 140 determines information the user requests through the input unit 130 among the information required for every day life received from the receiver unit 110 and stored in the storage unit 120, and displays on the display unit 150. That is, the control unit 140 controls to retrieve the information the user requests from the information required for every day life stored in the storage unit 120, and to display on the display unit 150. In the meantime, if there is no request from the user, the control unit 140 controls to display the information the user requests before among the information required for every day life stored in the storage unit 120, automatically.

The display unit 150 displays information the user desires to an outside of the refrigerator. That is, the display unit 150 displays the information retrieved by the control unit 140 under the request of the user from the information required for every day life stored in the storage unit 120. The display unit 150 displays only information the user requests through the control unit 140, and if there is no user's request, the display unit 150 can display the information the user requests before, automatically. In the meantime, the display unit 150 may be a display portion 151, such as an LCD window, or a separate display device, such as a TV monitor, or a computer monitor.

In the meantime, referring to FIG. 4, it is preferable that the display unit 150 and the input unit 130 are provided to the same control panel for convenience of use. The display unit 150 may display the user requests on the display portion 151, such as an LCD window, with characters, or an avatar corresponding to the information the user requests. For an example, as shown in FIG. 5, if the information the user requests is weather of the day, and the weather of the day will be cold due to sudden temperature drop, the avatar may be a character with mask and trembling entire body, and, if the weather of the day will be hot due to sudden temperature rise, the avatar may be a character with a hand fan in hand or thin clothes, such as a swimming suite, or as shown in FIG. 6, a sun with a sun glass.

In the refrigerator 10 in accordance with the first preferred embodiment of the present invention, a process for displaying information required for every day life will be described with reference to FIG. 7.

Upon putting the refrigerator 10 into operation, the receiver unit 110 receives information required for every day life, such as information on weather and information on food from an external server 30, such as a weather telecasting server and a food information server, through a network 20, like the Internet.

The information required or every day life received through the receiver unit 110 is stored in the storage unit 120 in real time.

During this process, if the user inputs required information through the input device, the control unit 140 retrieves the information the user request from the information required or every day life stored in the storage unit 120.

Then, the control unit displays the information required for every day life retrieved thus on the display unit 150 with characters or an avatar, to provide the user with the information required or every day life.

According to this, the user can be provided with various kinds of information required for every day life and utilizes the information in the user's every day life.

For an example, if the user requests information on weather, the control unit 140 determines and retrieves information on weather from the information required for every day life stored in the storage unit 120, and displays on the display unit 150 for the user. If the information provided to the user thus is information that a rainy season starts after one week, the user may request information on prices of food (particularly, vegetables) during a prior rainy season. Then, the control unit 140 retrieves information on food and information on prices from the intimation required for every day life stored in the storage unit 120, and provides the information to the user through the display unit 150. According to this, the user utilizes the information in buying food, enabling the user to make an economic buying activity. Of course, this example is no more than a simple embodiment, and the information can be used in various ways conveniently in practical life according to user's various demands, such as user's intention, tastes, and so on.

A refrigerator 10 in accordance with a second preferred embodiment of the present invention will be described with reference to FIGS. 8 to 13.

Referring to FIGS. 8 and 9, alike the first embodiment, the refrigerator 10 in accordance with a second preferred embodiment of the present invention includes a receiver unit 210, a storage unit 120, a control unit 140, an input unit 130, and a display unit 150.

However, different from the first embodiment, the refrigerator 10 in accordance with the second preferred embodiment of the present invention receives the information required for every day life through radio communication, and provides the information to the user.

In more detail, referring to FIG. 10, the receiver unit 210 in accordance with the second preferred embodiment of the present invention includes an antenna 211 for receiving radio wave from a broadcasting apparatus, and a receiver module 213 for receiving the information required for every day life from the radio wave from the antenna 211.

It is preferable that the antenna 211 is projected upward from the refrigerator 10 for effective reception of the radio wave. That is, the antenna 211 has one side connected to the reception module 213, and the other side projected upward from a refrigerator door 11. In this instance, it is preferable that the other side of the antenna 211 is projected outward through a door hinge 50 a top surface if the refrigerator 10. That is, the one side of the antenna 211 is connected to the receiver module 213 in the door 11, and the other side of the antenna 211 is extended along an inside of the door 11 to an upper side thereof, and exposed to an outside of the door 11 through the door hinge 50.

A mounting structure of the antenna 211 in which the antenna 211 is projected upward from the refrigerator 10 through the door hinge 50 will be described in more detail. The door hinge 50 includes a fixing plate 51 having a pass through tube 51*a* connected to a hinge hole 11*a* in the door 11, and a hinge cover 52 having an exposure hole 52*a* for protecting the other side of the antenna 211.

The fixing plate 51 is fixed to the upper surface of the refrigerator 10 corresponding to the door 11 in a state the pass through tube 51*a* is connected to the hinge hole 11*a* in the door 11. The hinge cover 52 is fixed to an upper side of the fixing plate 51. Then, the other side of the antenna 211 is projected upward from the refrigerator 10 through the pass through tube 51*a* of the fixing plate 51, with an end thereof exposed to an outside of the hinge cover 52 through the exposure hole 52*a*.

In the meantime, referring to FIG. 11, the control unit 140 is a printed circuit board (PCB) having various electronic components provided thereto. Mounted on the PCB, there are the receiver module 213 of the receiver unit 210, the input unit 130 with various kinds of buttons, and a display unit 150 with a display portion 151 like an LCD window.

The receiver module 213 is connected to the PCB by coupling terminals. That is, the PCB has a male terminal type of plug connector 140*a* and the receiver module 213 has a female terminal type of socket connector 213*a*, such that the receiver module 213 is coupled to the PCB as the socket connector 213*a* is coupled to the plug connector 140*a*.

In the meantime, on a front surface of the control unit 140 of the PCB, a plate may be attached for protection of the various kinds of components and maintenance. That is, as shown in FIG. 10, a transparent plate 160 of, such as glass, is mounted on the front surface of the PCB, for covering fronts of the receiver module 213, the input unit 130, and the display unit 150 on the PCB and forming a frontal appearance of the control unit 140. In this instance, it is preferable that the plate 160 exposes the input unit 130 to an outside of the PCB for the user to operate the input unit 130, and portion excluding the display unit 150 is formed of non-transparent material for sense of beauty.

In the meantime, in the foregoing refrigerator 10 in accordance with the second preferred embodiment of the present invention, a process for providing information required for every day life is similar to the first embodiment, of which description will be omitted.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

First, the refrigerator of the present invention can improve functions of the refrigerator, such as providing various kinds of information required or every day life to the user.

Second, the refrigerator of the present invention can improve user's convenience and efficiency by providing various kinds of information required for every day life to the user.

Third, the refrigerator of the present invention can improve efficiency of information by providing various kinds of information required for every day life to the user.

Fourth, the refrigerator of the present invention can improve user's economy and quality of life by providing various kinds of information required for every day life to the user to help the user to make economic purchase.

The invention claimed is:

1. A refrigerator comprising:

a receiver unit for receiving information useful for daily life;

a control unit for determining information a user needs from the information useful for daily life; and a display unit for displaying the information the user needs to an outside of the refrigerator, wherein the receiver unit includes:

an antenna; and a receiver module for receiving the information useful for daily life from a radio wave through the antenna, and wherein the antenna projects outward through a door hinge on top of the refrigerator.

2. The refrigerator as claimed in claim 1 , wherein the information useful for daily life comprises information on weather.

3. The refrigerator as claimed in claim 2, wherein the information on weather includes information on weather in the future.

4. The refrigerator as claimed in claim 2, wherein the information useful for daily life includes information on a particular day in the future, or information on a particular period in the future which can be selected by the user.

5. The refrigerator as claimed in claim 1, wherein the information useful for daily life includes information on weather, and information on food relevant to the information on weather.

6. The refrigerator as claimed in claim 5, wherein the information on food includes information on price of the food.

7. The refrigerator as claimed in claim 1, wherein the receiver unit receives the information useful for daily life from an external network through wire or radio.

8. The refrigerator as claimed in claim 1, wherein the antenna has one side connected to the receiver module, and another side projected outward from a top side of a refrigerator door.

9. The refrigerator as claimed in claim 1, wherein the door hinge has a hole formed therein through which the antenna passes.

10. The refrigerator as claimed in claim 1, wherein the receiver module is coupled with the control unit of the refrigerator by terminal coupling.

11. The refrigerator as claimed in claim 1, wherein the receiver unit is detachably mounted to one side of a body of the refrigerator.

12. The refrigerator as claimed in claim 1, further comprising a storage unit for storing the information useful for daily life, and information relevant to the information useful for daily life.

13. The refrigerator as claimed in claim 12, wherein the information relevant to the information useful for daily life is avatar information.

14. The refrigerator as claimed in claim 12, wherein the information relevant to the information useful for daily life is regional information.

15. The refrigerator as claimed in claim 1, further comprising an input unit for inputting the information relevant to the information useful for daily life.

16. The refrigerator as claimed in claim 1, wherein the display unit displays the information the user needs with characters.

17. The refrigerator as claimed in claim 1, wherein the display unit displays the information the user needs with an avatar.

18. The refrigerator as claimed in claim 1, wherein the display unit displays information the user selects.

* * * * *